United States Patent [19]

Knaak

[11] 4,182,611

[45] Jan. 8, 1980

[54] ROLLER-HEARTH FURNACE WITH SHIELDED ROLLERS

[75] Inventor: Rüdiger Knaak, Neuss, Fed. Rep. of Germany

[73] Assignee: Koppers-Wistra-Ofenbau GmbH, Duesseldorf-Heerdt, Fed. Rep. of Germany

[21] Appl. No.: 890,709

[22] Filed: Mar. 24, 1978

[30] Foreign Application Priority Data

Mar. 25, 1977 [DE] Fed. Rep. of Germany ..... 2713139

[51] Int. Cl.[2] ..... F27D 3/00

[52] U.S. Cl. ..... 432/245; 432/246

[58] Field of Search ..... 432/245, 246

[56] References Cited

U.S. PATENT DOCUMENTS

| | | | |
|---|---|---|---|
| 2,932,497 | 4/1960 | Dailey et al. | 432/245 X |
| 3,070,362 | 12/1962 | Young et al. | 432/246 |
| 3,570,827 | 3/1971 | Breedon | 432/245 |

*Primary Examiner*—Edward G. Favors

*Attorney, Agent, or Firm*—Michael J. Striker

[57] ABSTRACT

A roller-hearth furnace has workpiece-supporting rollers which are thermally shielded at the sides and from below. Intermediate the rollers the workpieces are exposed to heat action from below.

10 Claims, 5 Drawing Figures

FIG. 3
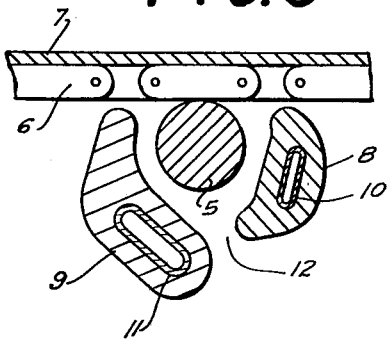
FIG. 2
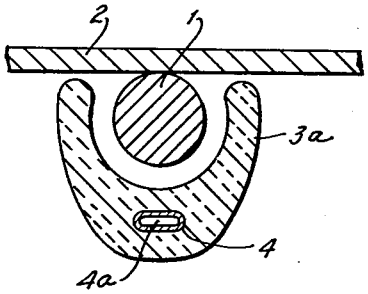
FIG. 5
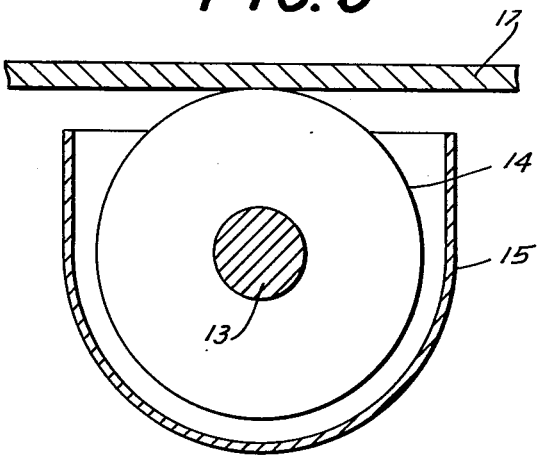
FIG. 1
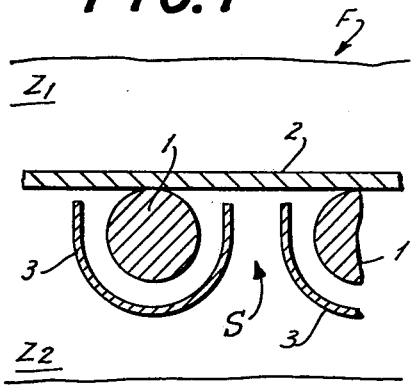
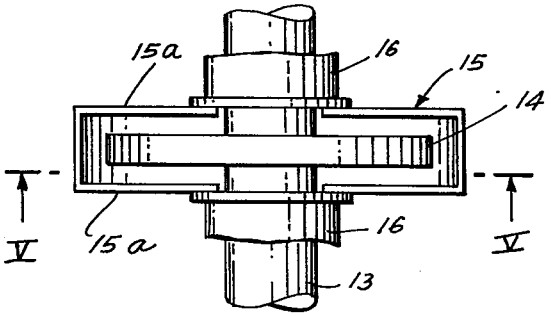
FIG. 4

ROLLER-HEARTH FURNACE WITH SHIELDED ROLLERS

BACKGROUND OF THE INVENTION

1. Field of the Invention

This invention relates to roller-hearth furnaces.

2. The Prior Art

Conventional roller-hearth furnaces are generally used for the heat-treatment of workpieces where rapid heating is either not possible or not desirable. They cannot be used for heat-treatments where rapid heating of workpieces, such as plates or strips, to high temperatures is required. For this latter type of heat-treatment it is typically necessary to employ soaking-pit and similar furnaces in which rapid heating can take place.

Also, in many instances it is undesirable—from the viewpoint of the end results desired for the workpieces—to heat too rapidly. For such applications the relatively slow-heating roller-hearth furnaces have heretofore been used in which the differential between furnace heat and workpiece temperature is limited to not very high values at all points of the furnace interior, in contrast to other heat-treating furnaces where it is often immaterial for the qualities of the treated workpieces that substantial temperature differences exist between the workpieces and the furnace heat.

However, for a variety of reasons know to those conversant with the art it is desirable to be able to employ roller-hearth furnaces also for the rapid heating of workpieces. In fact, repeated attempts have been made to construct special high-performance roller-hearth furnaces for this purpose. These special furnaces are characterized in that substantial differences can develop locally between the furnace temperature and the workpiece temperature, especially in the region where the workpiece enters the furnace and are rapidly heated to high temperatures. These attempts have never been successful because the rollers of the hearth were unable to withstand the prevailing conditions and became damaged so rapidly that their reduced service life made the proposition uneconomical. Attempts at providing rollers of improved construction and/or materials have heretofore always failed.

SUMMARY OF THE INVENTION

It is an object of the present invention to overcome the prior-art disadvantages.

More particularly, it is an object of the invention to provide an improved roller-hearth furnace which is capable of heating workpieces rapidly to high temperatures, but without accepting a deterioration in the service life of the hearth rollers.

In keeping with these and other objects which will become apparent hereafter, one aspect of the invention resides in a roller-hearth furnace for high-temperature use which, briefly state, may comprise a plurality of axially parallel rollers; and means for shielding each of the rollers laterally and from below against direct exposure to the heated atmosphere in the furnace, so as to prevent heating of successive roller-surface increments to a temperature which is so much higher than the workpiece temperature as to cause premature deterioration of the roller material due to alternating heating and cooling of the roller-surface increments.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a fragmentary vertical longitudinal section through a roller-hearth furnace embodying the invention;

FIG. 2 is a view similar to FIG. 1 but of another embodiment;

FIG. 3 is also a view similar to FIG. 1 but illustrates a further embodiment;

FIG. 4 is a fragmentary top-plan view of an additional embodiment of the invention; and FIG. 5 is a section on line V—V of FIG. 4.

DESCRIPTION OF THE PREFERRED EMBODIMENTS

Referring now to the drawing, it should be understood that no attempt has been made to illustrate those aspects of a roller-hearth furnace which are conventional, i.e., known per se.

With this in mind it will be seen that FIG. 1 only diagrammatically shows the heating chamber of a roller-hearth furnace having an upper heating zone $Z_1$ and a lower heating zone $Z_2$. There will, of course, be the requisite conventional heating devices, such as burners, and the hearth will be constructed in known manner as an array of parallel rollers 1 (only two shown) on which workpieces 2 travel (either leftward or rightward in FIG. 1). Rollers 1 are journalled for rotation, also in a manner known per se.

In accordance with the invention, however, each of the rollers 1 is provided with a thermal shield 3 which here is in form of a substantially U-shaped baffle which surrounds the roller 1 at the sides thereof and from below. Because of this shield 3 the successive movements of the roller surface are shielded against exposure to strongly varying temperatures during rotation of the roller. This avoids the prior-art disadvantage which is primarily responsible for early deterioration of the rollers, namely the fact that as each roller-surface increment sequentially faces laterally or downwardly (and is thus exposed to the zone $Z_2$) it is strongly heated. The workpieces 2, especially as they traverse the upstream half of the furnace chamber, have a temperature which is substantially lower than the furnace temperature. Therefore, the increments of the roller surface are cooled drastically when they come into contact with the relatively cold workpiece; this results in a rapid succession of heating and cooling of the rotating rollers and causes their premature destruction.

The inventive heat shield 3, however, prevents this hot-cold-hot cycle since it protects the roller 1 against direct exposure to the heat in the zone $Z_2$. As a result, the temperature of each roller-surface increment—at the time it contacts the workpiece 2—is much closer to the workpiece temperature than in the prior art so that the deleterious effects of the hot-cold-hot cycle are eliminated or at least so substantially reduced that the service life of the rollers 1 is drastically increased, as compared to the prior art. Since the sheilds 3 of successive rollers are spaced from one another, as sh wn, the full heat from the zone $Z_2$ can impinge upon the workpiece 2 in the space S between successive shields. The shields may in all embodiments be made of metallic (e.g., steel, titane, molybdane, cobalt-alloys, nickel-chromium alloys) or ceramic material (aluminium-silicum-oxides, chromium oxide, silicum carbide).

According to the embodiment of FIG. 2, the shield 3a may be provided with an, e.g. embedded carrier 4 having a passage 4a through which a cooling medium (e.g., water) may circulate when passage 4a is connected to a known-per-se source of such cooling medium. The carrier 4 of course also serves to support and reinforce the shield 3a.

Particles (e.g., rust or other substances) may in some instances drop off the workpieces 2. These could clog the clearance between the shield and the roller 1. To avoid this, a construction such as the one illustrated in FIG. 3 may be employed, i.e., the shield may be provided with an opening through which such particles can drop out.

In the particular exemplary embodiment of FIG. 3 the hearth roller is identified with reference numeral 5, the workpiece with reference numeral 7 and a transporting chain for the workpiece with reference numeral 6.

The shield is here composed of two shield sections 8 and 9 which are provided with respective embedded carriers 10, 11 having passages for circulation of a cooling medium. The two shield sections 8, 9 define with one another an opening 12 which should advantageously be inclined as shown to prevent, or at least limit, the exposure of roller 5 to heat radiation from the zone $Z_2$ (see FIG. 1). With this construction any particles falling from above into the clearance between the roller 5 and the shield sections 8, 9 can drop out through the channel-shaped opening 12 whose presence, however, decreases the shielding effectiveness only to a very slight extent.

FIG. 4 and 5, finally, show an embodiment in which the hearth rollers 13 (one shown) have circular disks 14 (one shown) mounted on them. In this embodiment there will, of course, be two or more of these disks 14 mounted on the roller 13 at axially spaced locations (this is known per se) and the workpiece 17 will be supported on the disks 14 rather than on the core of the roller 13 directly. It is, therefore, not the core of the roller 13 per se which must be protected against the hot-cold-hot cycle, but the disks 14 which contact the workpiece and which form part of the roller.

For this purpose the heat shield 15, which may be of heat-resistant sheet metal, surrounds the respective disk laterally and from below as well as at its axial ends. It is mounted on a sidewall (not shown) of the furnace by means of one or more (two shown) tubular members 16 which themselves are connected to axial end walls 15a of the heat shield 15, so as to remain stationary while the core of the roller 13 (which extends through the members 16) and the disk 14 rotate.

All embodiments have, of course, in common that the increments of the roller or disk surface are protected against direct exposure to the heat in zone $Z_2$ so that, when they subsequently contact the workpiece, the temperature differential between the workpiece and these surface increments will be relatively small. This protects the rollers (or disks) and increases their service life, making the use of a roller-hearth furnace for rapid heating of workpieces to high temperatures, for the first time an economically viable proposition.

While the invention has been illustrated and described as embodied in a roller-hearth furnace, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fiarly constitute essential characteristics of the generic or specific aspects of this invention.

What is claimed as new and desired to be protected by Letters Patent is set forth in the appended claims.

1. In a roller-hearth furnace having a furnace chamber for high-temperature use, a combination comprising a plurality of axially parallel rollers exposed to heating from above and below and adapted to support workpieces thereon whereby the rollers are shielded against heating from above in the presence of such workpieces; and means for shielding each of said rollers laterally and from below against direct exposure to the heated atmosphere in the furnace while permitting access of the heated atmosphere from below between adjacent rollers to the workpieces supported thereon, so as to permit heating from below of the supported workpieces while preventing heating of successive roller-surface increments to a temperature which is so much higher than the workpiece temperature as to cause premature deterioration of the roller material due to alternating heating and cooling of the roller-surface increments.

2. A combination as defined in claim 1, said means comprising a heat-sheild on each of said rollers.

3. A combination as defined in claim 1, wherein said means comprises a metallic heat shield for each of said rollers.

4. A combination as defined in claim 1, wherein said means comprises a ceramic heat-shield for each of said rollers.

5. In a roller-hearth furnace for high-temperature use, a combination comprising a plurality of axially parallel workpiece-supporting rollers; and means for shielding each of said rollers laterally and from below against direct exposure to the heated atmosphere in the furnace, so as to prevent heating of successive roller-surface increments to a temperature which is so much higher than the workpiece temperature as to cause premature deterioration of the roller material due to alternating heating and cooling of the roller-surface increments, said means comprising for each of said rollers a heat-shield and a carrier for the same, said carrier being provided with passage means for circulation of a cooling medium therethrough.

6. In a roller-hearth furnace for high-temperature use, a combination comprising a plurality of axially parallel workpiece-supporting rollers; and means for shielding each of said rollers laterally and from below against direct exposure to the heated atmosphere in the furnace, so as to prevent heating of successive roller-surface increments to a temperature which is so much higher than the workpiece temperature as to cause premature deterioration of the roller material due to alternating heating and cooling of the roller-surface increments, said means comprising for each of said rollers a heat-sheild which defines a clearance with the respective roller, and each of said heat-shields having a generally downwardly directed opening communicating with said clearance so that particles dropping from above into said clearance can fall out of said opening.

7. A combination as defined in claim 6, wherein said opening is configurated as a channel inclined to the horizontal and to the vertical so as to prevent direct exposure of the respective roller to thermal radiation through the opening.

8. A combination as defined in claim 7, wherein each of said heat-shields is composed of two mutually inclined sections having surfaces which together bound said opening configurated as a channel.

9. In a roller-hearth furnace for high-temperature use, a combination comprising a plurality of axially parallel workpiece-supporting rollers; and means for shielding each of said rollers laterally and from below against direct exposure to the heated atmosphere in the furnace, so as to prevent heating of successive roller-surface increments to a temperature which is so much higher than the workpiece temperature as to cause premature deterioration of the roller material due to alternating heating and cooling of the roller-surface increments, said means comprising for each of said rollers a heat-shield of substantially U-shaped cross-section.

10. In a roller-hearth furnace for high-temperature use, a combination comprising a plurality of axially parallel workpiece-supporting rollers provided with coaxial disks on which the workpieces are supported; and means for shielding each of said rollers laterally and from below against direct exposure to the heated atmosphere in the furnace, so as to prevent heating of successive roller-surface increments to a temperature which is so much higher than the workpiece temperature as to cause premature deterioration of the roller material due to alternating heating and cooling of the roller-surface increments, said means comprising a heat-sheild of heat-resistant sheet metal surrounding each of said disks laterally and from below as well as at its axial ends, and at least one tubular carrier for mounting the heat-shield on a sidewall of the furnace.

* * * * *